US005864885A

United States Patent [19]

Grinberg

[11] Patent Number: 5,864,885

[45] Date of Patent: Feb. 2, 1999

[54] CUT-RESISTANT GLOVE WITH HANGING LOOP SYSTEM

[75] Inventor: Daniel Grinberg, New York, N.Y.

[73] Assignee: Island Polyethylene Bag & Supply Corp., Westbury, N.Y.

[21] Appl. No.: 99,222

[22] Filed: Jun. 17, 1998

[51] Int. Cl.[6] ..... A41O 19/00

[52] U.S. Cl. ..... 2/160; 2/159; 2/161.6

[58] Field of Search ..... 2/16, 159, 160, 2/161.6, 161.7, 162, 163, 166, 167, 170, 271; 223/111

[56] References Cited

U.S. PATENT DOCUMENTS

| | | | |
|---|---|---|---|
| 2,041,254 | 5/1936 | Lipshutz | 2/160 |
| 4,876,747 | 10/1989 | Coffey et al. | 23/168 |

FOREIGN PATENT DOCUMENTS

| | | |
|---|---|---|
| 286000 | 2/1928 | United Kingdom . |
| 406038 | 2/1934 | United Kingdom . |
| 2241869 | 9/1991 | United Kingdom . |

*Primary Examiner*—Michael A. Neas
*Assistant Examiner*—Gary L. Welch
*Attorney, Agent, or Firm*—Schweitzer Cornman Gross & Bondell LLP

[57] ABSTRACT

A cut-resistant glove with a hanging system including a hanging loop attached to the interior of the glove adjacent the edge of the opening thereof for attaching the glove to a hook. A protective flap is attached to the interior of the glove and extends over and substantially covers the hanging loop to prevent the hanging loop from catching or snagging the fingers of the user during donning and to prevent the hanging loop from accidentally extending out of the glove during use.

5 Claims, 2 Drawing Sheets

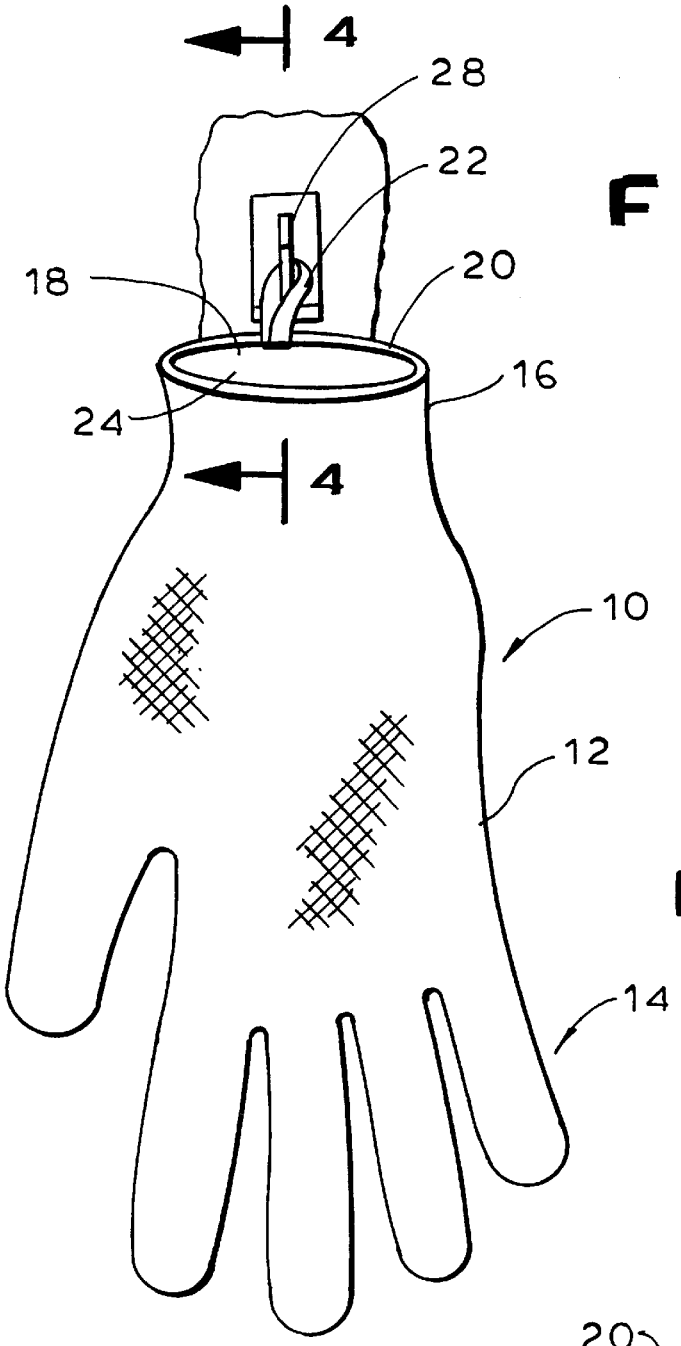
FIG. 3
FIG. 4
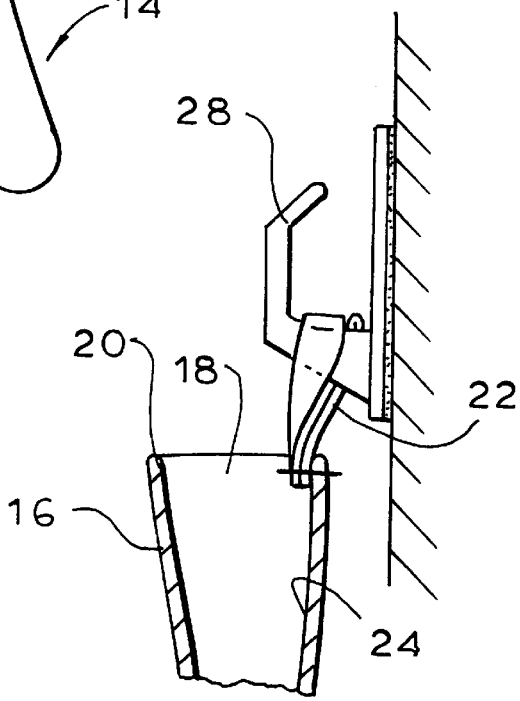

CUT-RESISTANT GLOVE WITH HANGING LOOP SYSTEM

FIELD OF INVENTION

This invention pertains to the field of utility gloves and, in particulars, to cut-resistant utility gloves.

BACKGROUND AND SUMMARY OF THE INVENTION

Cut-resistant utility gloves are designed to protect the hand and fingers from sharp objects and blades often encountered in the food handling and other industries. The gloves are manufactured with a relatively thick weave of strong fibers which inhibit punctures and cuts.

As a result of the method and materials employed in their manufacturing, the cut-resistant gloves are expensive as compared to standard cotton, plastic, or other non-cut-resistant gloves. Therefore, commercial organizations with employees using the cut-resistant gloves have a strong interest in extending the useful life and minimizing the loss of the gloves.

In addition, the food-handling industry in particular requires a high level of cleanliness. Therefore, contact of the gloves with soiled surfaces should be minimized. The gloves require periodic washing after which air drying is preferred.

Therefore, it is an object of the present invention to provide an inexpensive and efficient means to extend the useful life of and minimize the loss of cut-resistant gloves while providing a means to maintain the cleanliness of the gloves while not in use or while air drying after washing.

In accordance with the principles of the present invention, a new and improved cut-resistant glove is made from a specially woven fabric which resists cutting and tearing and which glove has a body and finger portions, preferably including an elastic cuff with a reinforced or bound edge. A hanging loop is attached to the bound cuff edge. The loop is preferably normally oriented to project into the cuff along its interior surface. The hanging loop is useful for suspending the glove on a hook in a predetermined location during periods of non-use and/or when drying.

Also attached to the bound edge of the cuff is a protective flap, advantageously a product label, which is superimposed upon the hanging loop. As with the hanging loop, the protective flap is preferably oriented to extend inwardly, along the interior surface of the cuff.

The protective flap serves to prevent the hanging loop from being accidentally snagged and possibly torn by a finger when donning the glove. In addition, the protective flap inhibits the hanging loop from extending outwardly from the cuff, to reduce the possibility that the hanging loop will unintentionally catch or snag exterior objects.

The protective flap and hanging loop can be attached to the bound cuff edge by sewing, gluing or other fastening means, either simultaneously or separately. The hanging hook useable with the glove can be of any type, advantageously a molded plastic hook with pressure-sensitive adhesive backing.

BRIEF DESCRIPTION OF THE DRAWINGS

For a complete understanding of the above and other features of the invention, reference shall be made to the following detailed description of the preferred embodiments of the invention and to the accompanying drawings, wherein:

FIG. 3 is a front elevational view of the glove of FIG. 1, shown suspended from a hanging hook; and FIG. 4 is a cut-away, side elevational view cross section view, taken along line 4—4 of FIG. 3.

DETAILED DESCRIPTION OF THE INVENTION

Figure 1:
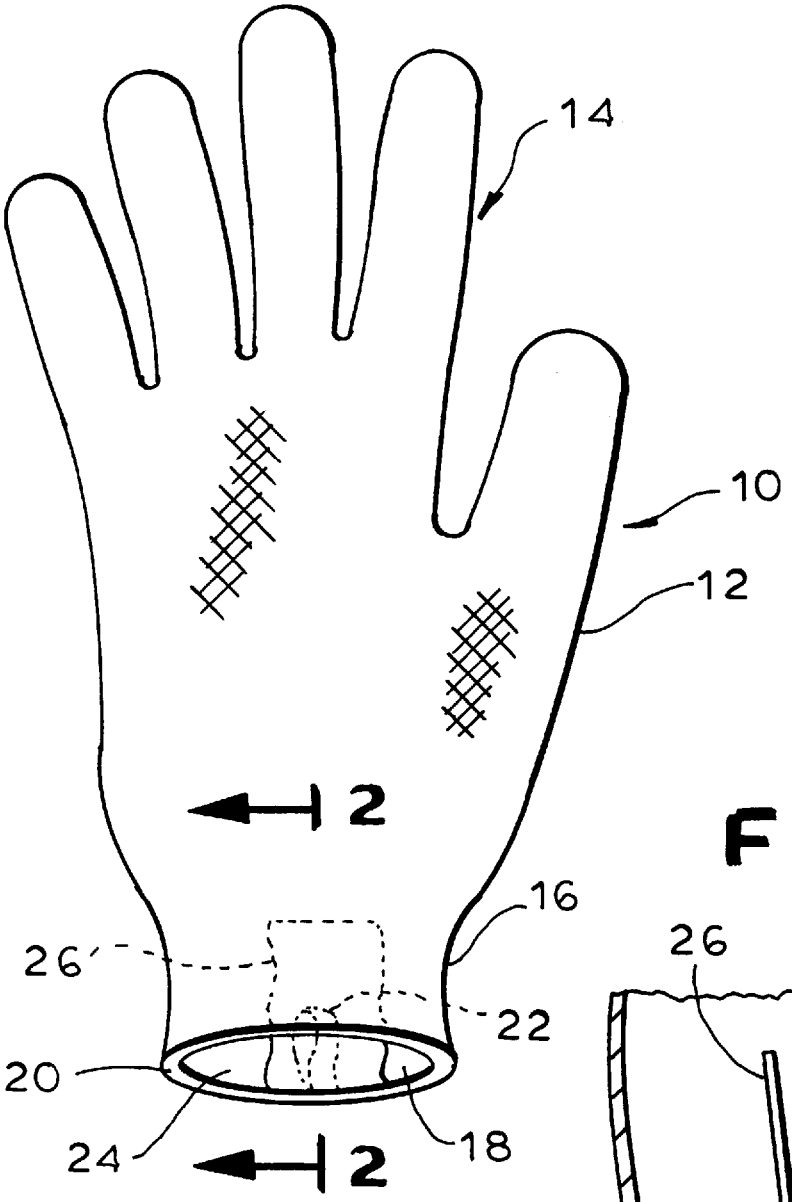
FIG. 1 is a front elevational view of the glove of the present invention.
Figure 2:
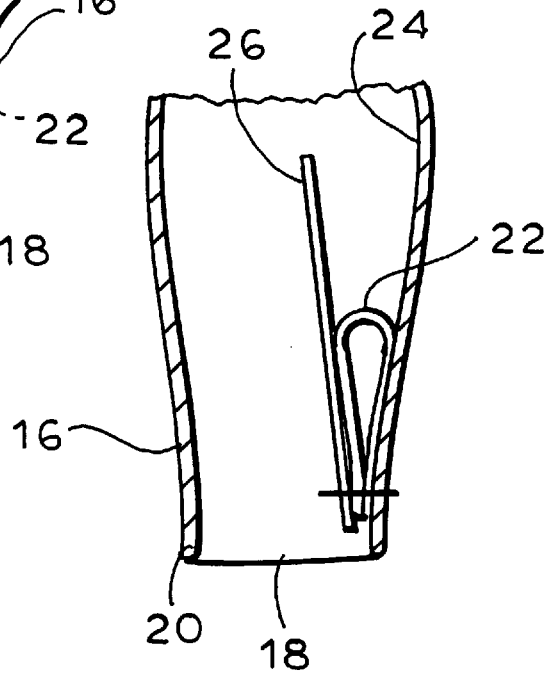
FIG. 2 is a cut-away, side elevational cross section view, taken along line 2—2 of FIG. 1.

Referring initially to FIGS. 1 and 2 of the drawings, the cut-resistant glove 10 of the present invention is preferably manufactured with a relatively thick weave of strong fibers which inhibit lacerations and other injuries to the hand. Advantageously the glove fabric is 7–13 gauge polyester having a steel core in the heaviest gauges for heavy duty applications. The glove 10 has body and finger portions 12, 14 and a preferably elastic cuff portion 16 with an opening 18 surrounded by a bound edge 20.

Attached adjacent (or directly attached to) the bound edge 20 is a hanging loop 22 which is normally (i.e., when in a rest position and not subject to any forces) oriented to extend from the edge 20 into the glove interior along an interior surface 24 of the cuff 16 of the glove 10.

Also attached adjacent or directly to the bound edge 20 is a protective flap 26 which normally extends over the hanging loop 22, preferably substantially parallel to the interior surface 24 of the cuff portion 16 of the glove 10. The protective flap 26 preferably entirely covers the hanging loop 22, when in a non-deployed position. That is, the protective flap 26 is preferably longer and wider than the hanging loop 22, with the hanging loop 22 aligned along a center axis of the protective flap 26. It will be appreciated that the protective flap 26, because it completely covers the hanging loop 22, prevents the hanging loop 22 from being caught or snagged by a finger when donning the glove.

Referring to FIGS. 3 and 4, the hanging loop 22 has an extended position in which the loop 22 extends outwardly from the opening 18 of the glove 10. Thus, the glove 10 may be conveniently stored or air dried on any suitable hook, such as the inexpensive self-adhesive hook 28 depicted, which hook may be mounted in any suitable convenient location. As shown, when the hanging loop 22 is in the deployed position projecting from the cuff, the protective flap 26 also extends outwardly in a non-interfering manner.

Thus, the new and improved cut-resistant glove of the present invention includes an inexpensive and efficient means to store and air dry the glove, to extend the useful life of the glove and minimize loss, while maintaining a high level of cleanliness, without increasing the effort required to don, use or clean the glove.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A cut-resistant glove, comprising:

(a) a body portion, a cuff portion, and an opening having a bound edge;

(b) a hanging loop attached to said cuff portion adjacent said bound edge;

(c) a protective flap attached to said cuff portion adjacent said bound edge; and (d) said protective flap being located above and substantially covering said hanging loop;

(e) whereby, when said glove is donned, said protective flap prevents said hanging loop from contacting the hand or fingers of the wearer, and whereby said protective flap inhibits said hanging loop from extending out of said glove.

2. A cut-resistant glove, as in claim 1, wherein said protective flap is longer and wider than said hanging loop and extends into said interior of said glove a distance sufficient to inhibit the hanging loop from extending outwardly from said opening.

3. A cut-resistant glove, as in claim 2, wherein said cuff portion includes elastic bands and wherein said protective flap extends from said bound edge inwardly along substantially all of said cuff portion of said glove.

4. A cut-resistant glove as in claim 1, wherein said hanging loop is comprised of elastic material.

5. A cut-resistant glove with a hanging system comprising a cut-resistant glove as in claim 1 and further comprising a hook for suspending said glove, said hook having a pressure-sensitive adhesive backing.

* * * * *